US005904580A

United States Patent [19]

Kozel et al.

[11] Patent Number: 5,904,580

[45] Date of Patent: May 18, 1999

[54] ELASTOMERIC CONNECTOR HAVING A PLURALITY OF FINE PITCHED CONTACTS, A METHOD FOR CONNECTING COMPONENTS USING THE SAME AND A METHOD FOR MANUFACTURING SUCH A CONNECTOR

[75] Inventors: Charles A. Kozel, McHenry; James M. Kudla, Mount Prospect; Mark Stack, Hoffman Estates, all of Ill.

[73] Assignee: Methode Electronics, Inc., Chicago, Ill.

[21] Appl. No.: 08/796,256

[22] Filed: Feb. 6, 1997

[51] Int. Cl.[6] ..... H01R 9/09

[52] U.S. Cl. ..... 439/66; 439/91

[58] Field of Search ..... 439/66, 91, 387, 439/886, 590

[56] References Cited

U.S. PATENT DOCUMENTS

| | | | |
|---|---|---|---|
| 3,934,959 | 1/1976 | Gilissen et al. | 439/66 |
| 3,954,317 | 5/1976 | Gilissen et al. | 439/66 |
| 4,593,961 | 6/1986 | Cosmo | 439/66 |
| 4,793,814 | 12/1988 | Zifcak et al. | 439/66 |
| 5,230,632 | 7/1993 | Baumberger et al. | 439/74 |
| 5,430,614 | 7/1995 | Difrancesco | 361/785 |

FOREIGN PATENT DOCUMENTS 1-157075 6/1989 Japan .

OTHER PUBLICATIONS

Lambert, William R. et al.: "Elastomeric Connectors–Attributes, Comparisons and Potential," AT&T Bell Laboratories technical Paper, Whippany, NJ pp. 1512–1526.

Brochure entitled: "Elastomeric Connectors," by Fujipoly, Kenilworth, NJ, pp. 4–5.

*Primary Examiner*—Neil Abrams
*Assistant Examiner*—T C Patel
*Attorney, Agent, or Firm*—David L. Newman

[57] ABSTRACT

An elastomeric connector having fine pitched contacts is provided in addition to a method for connecting components using such a connector and a method of manufacturing the same. The connector includes a body formed from an elastomeric material with contacts arranged to extend through the body and exposed at each side of the body. The contacts are bent to form a contact surface that is oriented at an angle with respect to the sides of the body. The contacts may include a radiused section that is formed in the elastomeric material. Grooves may be formed in the body of the connector separating adjacent contacts and providing additional flexibility of the connector.

13 Claims, 5 Drawing Sheets

ELASTOMERIC CONNECTOR HAVING A PLURALITY OF FINE PITCHED CONTACTS, A METHOD FOR CONNECTING COMPONENTS USING THE SAME AND A METHOD FOR MANUFACTURING SUCH A CONNECTOR

BACKGROUND OF THE INVENTION

The present invention generally relates to a connector, particularly a high density connector. More specifically, the present invention relates to an elastomeric connector particularly suitable for interconnection between a device and a printed circuit board or between two or more printed circuit boards requiring fine pitch interconnection. The present invention further relates to a method for connecting two components and a method for manufacturing such a connector.

It is, of course, generally known to provide connectors for providing interconnection between components, such as printed circuit boards and other devices that require the interconnection under conditions of high density, fine pitch, as well as requiring high performance.

An important consideration in the manufacture and design of elastomeric connectors is the contact force applied to the connectors which affects the performance and reliability of the same. This is particularly relevant for connectors that are repeatedly mated and unmated with the devices or printed circuit boards in which they are associated. In addition, taking this factor into consideration, current elastomeric connectors are costly to manufacture and nonetheless often encounter problems such as permanent deformation of the contact or contacts of the connector due to the large contact forces required when using the same.

In addition, most known elastomeric connectors do not provide "wiping action" to break down oxidation layers produced through use of the connector. Without the wiping action, oxidation layers or buildup is often formed on the contact causing the connector to become unreliable in its performance. Wiping action serves to clean the metallic contacts during insertion and assists in maintaining clean surfaces at the interface during operation of the device in which the connector is implemented. Wiping action is particularly important for separable connectors that require repetitive mating and unmating and also in environments where dust can be a factor.

A need, therefore, exists for an improved elastomeric connector that overcomes the deficiencies of known elastomeric connectors and improves the reliability and performance of the contact even through repeated usage of the same. In addition, a method for connecting components using such a connection as well as a method for manufacturing such a connector are also needed.

SUMMARY OF THE INVENTION

The present invention relates to a high density elastomeric connector with contacts that absorb the force applied to the connector. In addition, the present invention provides an elastomeric connector with electrical contacts molded into an elastomer that provide wiping action. A method for connecting components and a method for manufacturing such a connector are also provided.

In an embodiment of the present invention, a connector is provided. The connector has a body formed from an elastomeric material having a first side and a second side. A plurality of contacts is arranged uniformly in the body such that each contact integrally extends from the first side to the second side of the body wherein ends of each of the plurality of contacts are exposed at each of the first side and the second side.

In an embodiment, the contacts are bent at a point near each of the ends to form a contact surface such that the contact surfaces are oriented at an angle with respect to the sides of the body.

In an embodiment, each of the plurality of contacts is substantially parallel to one another.

In an embodiment, a portion of each of the contacts in the elastomeric material of the body includes a radiused section. The radiused section is substantially at a point halfway between the first side and the second side.

In an embodiment, the angle between the contact surfaces and the sides of the body is acute.

In an embodiment, the contact surfaces include a particle formed thereon. The particle is made from diamonds.

In an embodiment, a lip is integrally formed with each of the contact surfaces and each is formed at an angle with respect to the contact surface.

In an embodiment, third and fourth sides are perpendicular to the first and second sides of the body wherein the first, second, third and fourth sides define the body. Grooves may be formed in the third and fourth sides of the body wherein the grooves separate adjacent contacts extending through the body.

In an embodiment, the elastomeric material is silicone.

In another embodiment of the present invention, a method is provided for connecting two components. The method comprises the steps of: providing a connector wherein the connector has a body formed from an elastomeric material, the body having a first side and a second side; providing a plurality of contacts arranged uniformly and extending between the first side and the second side of the body of the connector wherein each of the plurality of contacts has a contact surface that is exposed at the first side and the second side of the body; and connecting components to the connector thereby providing an electrical connection between the components via the connector.

In an embodiment, particles are provided on the contact surfaces of the contacts.

In an embodiment, grooves are formed in the body of the connector.

In an embodiment, the contact surfaces are compressed during connection of the components.

In an embodiment, each of the, plurality of contacts includes a non-linear section formed in the body of the connector.

In another embodiment of the present invention, a method for manufacturing a connector is provided. The method comprises the steps of: providing a plurality of contacts in chain form or with carriers; molding elastomeric material forming a body around a portion of the contacts wherein the contacts are substantially spaced and parallel to one another; and removing a carrier member at ends of each of the plurality of contacts such that only a finite portion forming a contact surface is exposed adjacent the body.

In an embodiment, a radiused section is provided in each of the plurality of contacts before molding such that the radiused section is within the body after molding.

In an embodiment, particles are provided on the contact surfaces.

In an embodiment, grooves are formed in exterior walls of the body.

It is, therefore, an advantage of the present invention to provide an elastomeric connector, a method of manufacturing such a connector, as well as a method of connecting components having a contact or a plurality of contacts that absorbs the majority of the force applied to the connector.

Another advantage of the present invention is to provide an elastomeric connector, a method of manufacturing such a connector, as well as a method of connecting components that implements electrical contacts molded into an elastomer.

Yet another advantage of the present invention is to provide an elastomeric connector, a method of manufacturing such a connector, as well as a method of connecting components with contacts that provide a wiping action particularly suitable for removing buildup on the contact from oxidation.

And, another advantage of the present invention is to provide an elastomeric connector, a method of manufacturing such a connector, as well as a method of connecting components that implements contacts that are resilient and do not permanently deform.

Moreover, an advantage of the present invention is to provide an elastomeric connector, a method of manufacturing such a connector, as well as a method of connecting components wherein the connector is manufactured via injection molding and/or progressive stamping.

A still further advantage of the present invention is to provide an elastomeric connector, a method of manufacturing such a connector, as well as a method of connecting components that is inexpensive.

Yet another advantage of the present invention is to provide an elastomeric connector, a method of manufacturing such a connector, as well as a method of connecting components wherein the connector can be manufactured in various shapes to meet specific requirements.

And, another advantage of the present invention is to provide an elastomeric connector, a method of manufacturing such a connector, as well as a method of connecting components that has contacts with high density and a fine pitch that also operates in a reliable manner and with high electrical and mechanical performance.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

The present invention generally relates to an elastomeric connector having contacts that are preferably insert molded into an elastomeric material, such as silicone. The elastomeric connector allows interconnection between, for example, a device and a printed circuit board or between two printed circuit boards requiring high density and fine pitch interconnection. The present invention further provides a method of connecting components using an elastomeric connector as well as a method of manufacturing such a connector.

Figure 1:
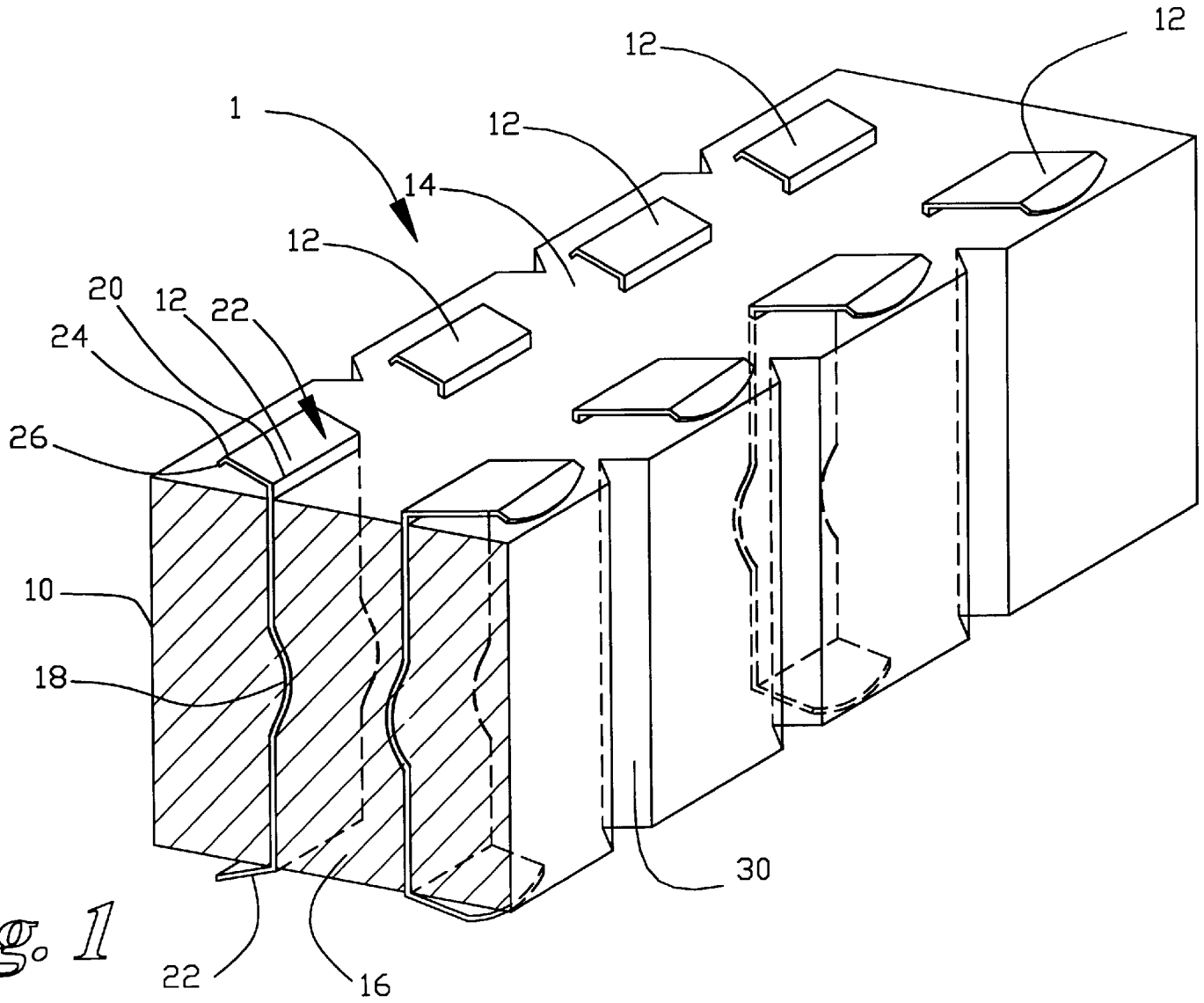
FIG. 1 illustrates a perspective view of an embodiment of an elastomeric connector of the present invention.

Referring now to the drawings wherein like numerals refer to like parts, FIG. 1 illustrates an embodiment of a connector 1 of the present invention. The connector 1 is formed from a body 10 and a plurality of contacts 12 extending from an exterior side 14 at one end of the body 10 through a width of the body 10 to an opposite exterior side 16 of the body 10. Preferably, the body 10 is constructed from an elastomeric material, such as silicone. As a result, the body 10 is flexible and capable of manipulation into various shapes and positions and provides a resiliency in order to help provide a spring force.

Figure 4:
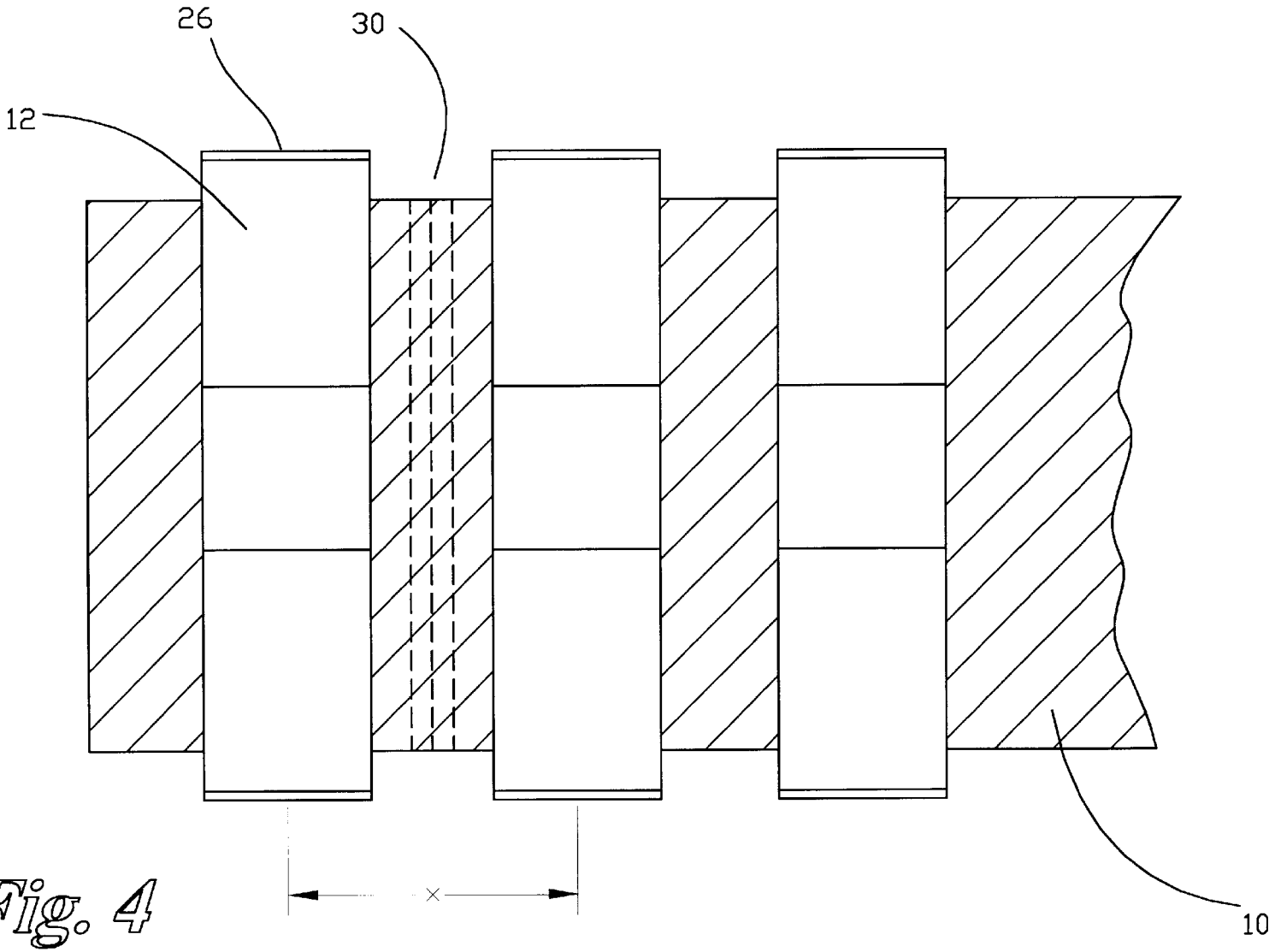
FIG. 4 illustrates a side view of an embodiment of an elastomeric connector of the present invention.

The contacts 12 of the present invention are preferably constructed from beryllium copper and have a thickness of approximately 0.003 inches. The contact may be plated with gold or plated with gold and nickel. Spacing between adjacent ones of the contacts 12 generally designated at X in FIG. 4 is approximately 0.019 inches or half millimeter or greater. To manufacture the connector 1, the contacts 12 may be provided on a carrier (not shown) that connects adjacent contacts. Preferably, the carrier uniformly connects the contacts integrally with the carrier.

As illustrated in FIG. 1, the portion of the contact 12 within the body 10 of the connector 1 is substantially linear between the exterior sides 14,16 except for a radiused section 18 formed substantially at a midpoint between the exterior sides 14, 16 of the body 10.

As further illustrated in FIG. 1, the contact 12 is exposed at the exterior sides 14,16 exterior to the body 10 of the connector 1. In an embodiment, exterior to the body 10, the contact 12 is bent at an edge 20 forming a contact surface 22 which, in turn, preferably forms an acute angle between the contact surface 22 and the exterior sides 14,16 of the body 10. At an edge 24 of the contact 12, a lip 26 is formed by bending the contact 12 as illustrated. The lip 26 helps to provide a defined point of electrical contact apart from the rough edge where the contact was sheared and separated from the carrier. As a result, symmetrical contact surfaces 22 are formed on each of the exterior sides 16,18 of the body 10 of the connector 1. The contact surfaces 22 provide connections between, for example, two printed circuit boards located on each side of the connector 1 or a printed circuit board and another device, as another example.

Figure 2:
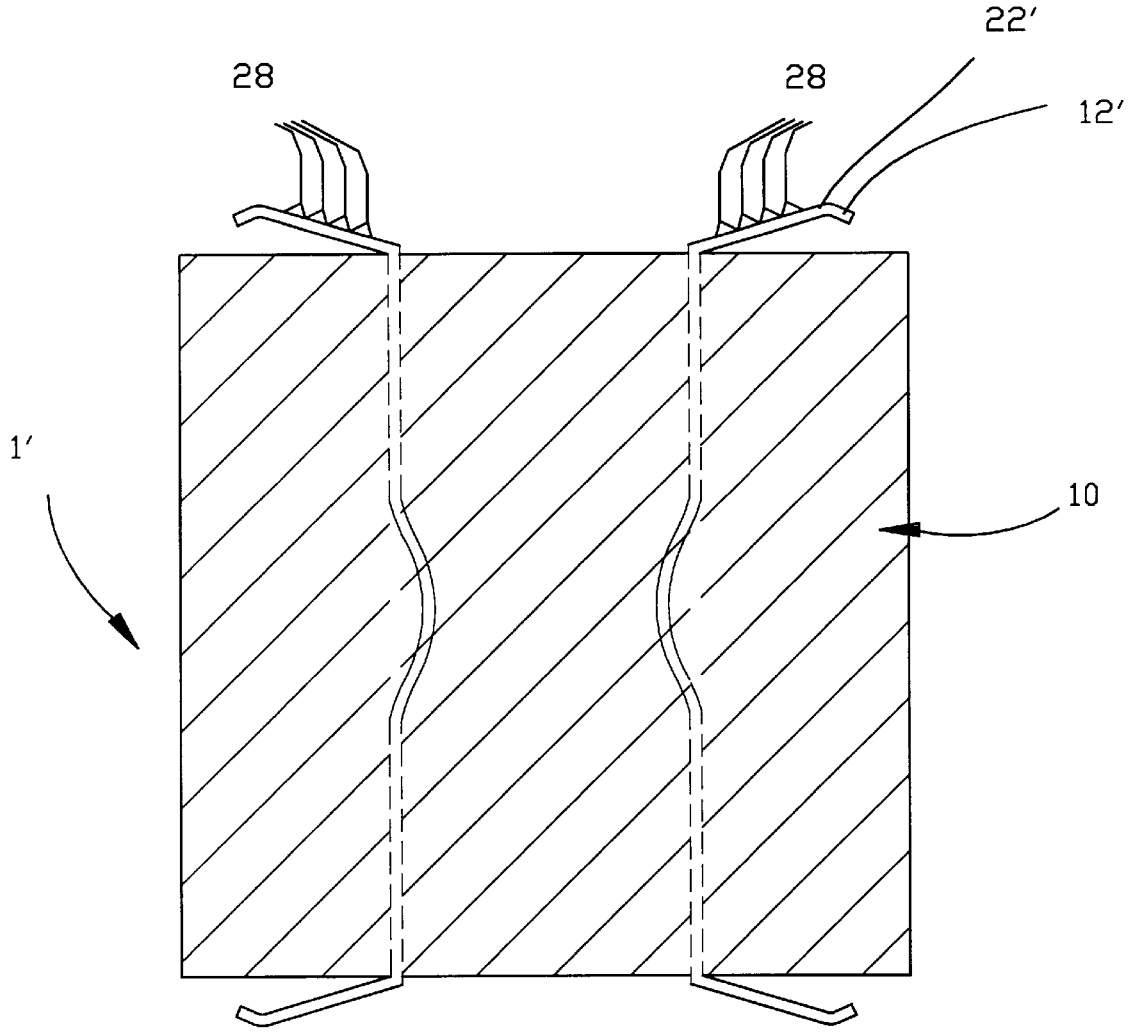
FIG. 2 illustrates a cross-sectional view of an embodiment of an elastomeric connector of the present invention incorporating particles on a surface of the contact.

Referring now to FIG. 2, a cross-sectional view of another embodiment of a connector 1' of the present invention is illustrated. The connector 1' includes a body 10 and a plurality of contacts 12'. Formed on the plurality of contacts 12' are particles 28, such as diamond particles plated on a contact surface 22' of the contact 12'. Although illustrated on only one side of the body 10 of the connector 1', the particles 28 may also be plated to the contact surfaces 22' on the opposite side of the body 10. The particles 28 assist in breaking down oxidation layers formed through oxidation on the contact surfaces 22'.

Figure 3:
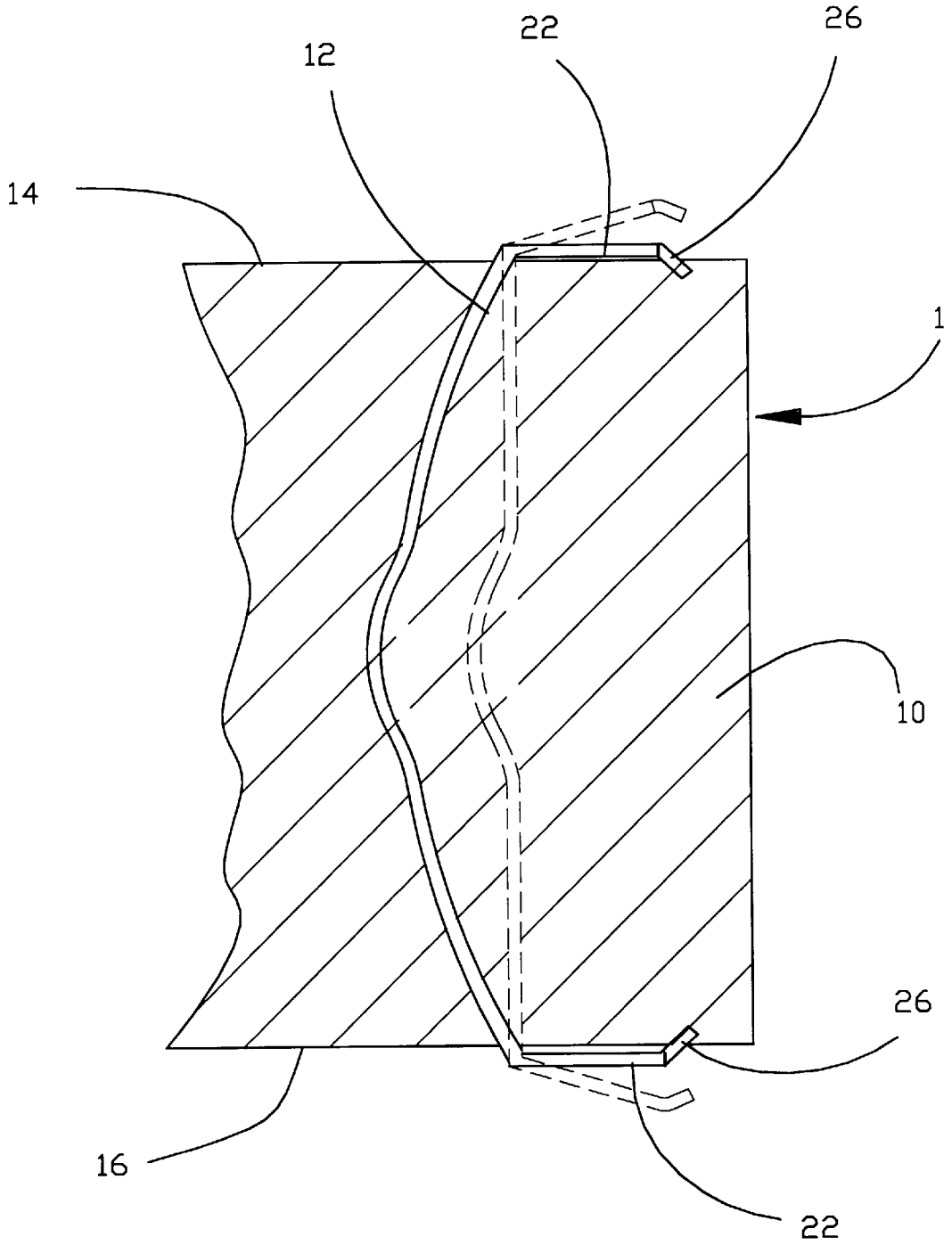
FIG. 3 illustrates a cross-sectional view of an embodiment of an elastomeric connector of the present invention with force applied to the contact of the connector.

FIG. 3 illustrates a cross-sectional view of the connector 1 in a position between, for example, two printed circuit boards (not shown) or a device and a printed circuit board, for example, i.e. during use of the connector 1. As shown, the contact surfaces 22 of the connector 1 are compressed such that the lip 26 of the contact 12 engages or otherwise contacts the exterior sides 14,16 of the body 10 of the connector 1. In turn, the contact 12 may also flex internally within the body 10 of the connector 1 as illustrated. That is, the elastomeric material of the body 10 allows for the flexure of the contact 12 within the interior of the body 10 due to the compression of the contact surfaces 22 of the contacts 12. Although the contact surfaces 22 are shown engaged or contacting the body 10, it should be understood that any degree of compression of the contact surface 22 of the contact 12 may result from implementation of the connector 1 in a system requiring a connection. In a preferred embodiment, once the contact surface 33 abuts against the exterior sides 14,16 of the elastomer body 10, the two members, e.g. the contact surface 22 and the elastomer body 10, compress simultaneously to provide the desired contact force. The contacts 12 and elastomeric body 10 combine to provide a predetermined spring force or compression distance dependent on the thickness and volume and composition of the elastomeric body 10 and the shape, weight and composition of the contacts 12. In a preferred embodiment, the connector has a working range of compression of between 0.005 inches to 0.025 inches.

Figure 5:
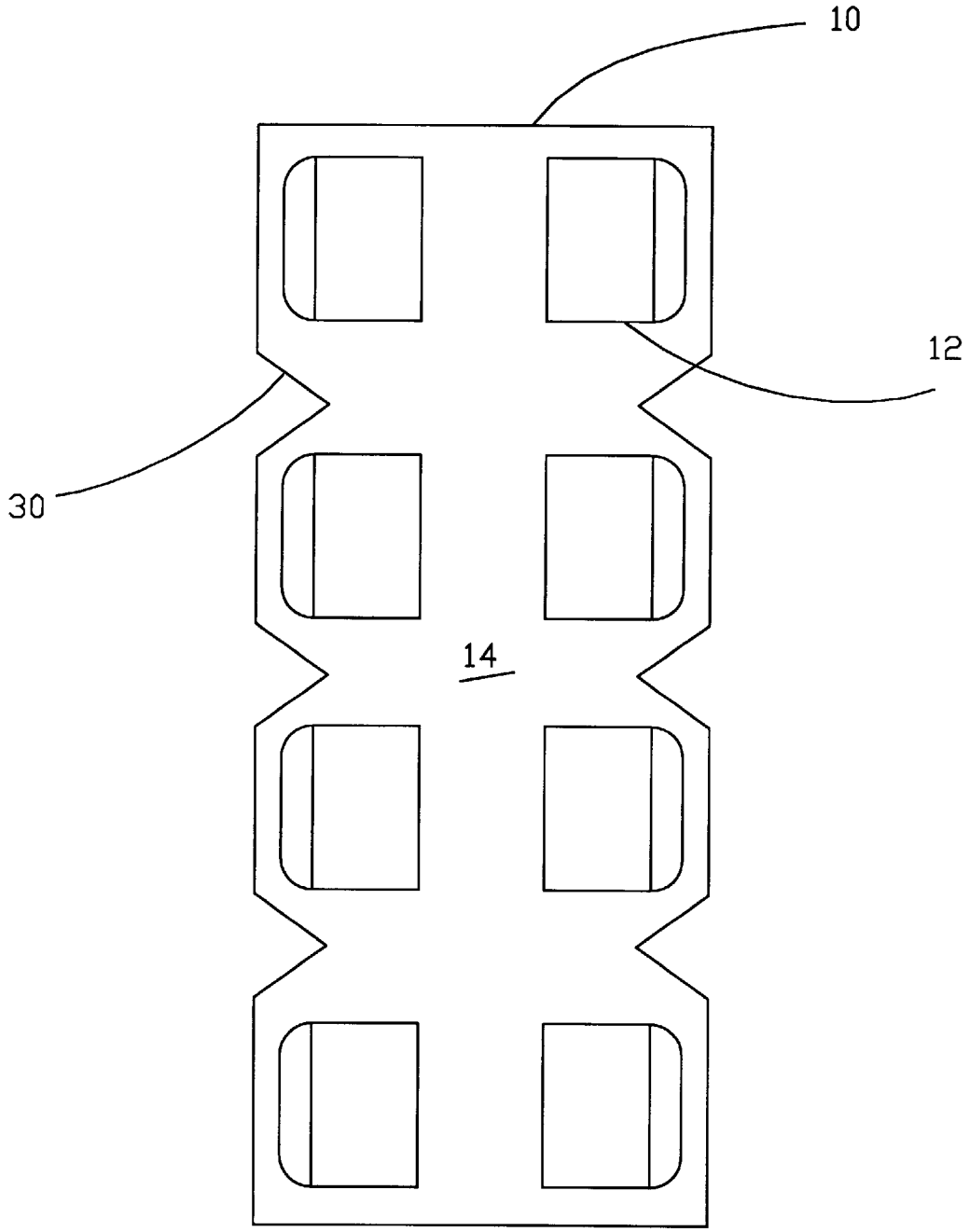
FIG. 5 illustrates a plan view of an embodiment of an elastomeric connector of the present invention.

Referring again to FIG. 1 and as more clearly shown in FIG. 5, grooves 30 are provided on an exterior surface of the body 10 of the connector 1. The grooves 30 in the body 10 may be used for alignment and location of the connector 1 during use. The grooves 30 are formed during the injection molding process of the elastomeric material onto the contacts 12. The shape or depth or geometric features of the grooves 30 may be designed to control the overall resiliency of the body. However, different shapes may be formed during the molding process to meet different requirements as required. Further, the positioning of the elastomer body within a receptacle or frame may be specifically designated in order to control the resiliency of the elastomer body.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

We claim:

1. A connector comprising:

a body formed from an elastomeric material having a first side and a second side; and a plurality of formed metal contacts arranged uniformly in the body such that each contact integrally extends from the first side of the second side of the body wherein the contacts provide a spring force and ends of each of the plurality of contacts include a terminal portion formed by a first bend in the contact at a point where it exits the body at each of the first side and the second side and the terminal portion includes a terminal point defined by the end of the contact, the terminal point is adjacent to a wiping point formed by a second bend in the terminal portion of the contact and the terminal portion forms an acute angle between the terminal portion and the side of the body wherein the wiping point and the terminal point are free from the body of the connector and upon compression of the connector the terminal portion, the wiping point and the terminal point are moved toward the side of the body and the terminal point presses into the side of the body displacing the elastomeric material.

2. The connector of claim 1 wherein each of the plurality of contacts is substantially parallel to one another.

3. The connector of claim 1 wherein a portion of each of the contacts in the elastomeric material of the body includes a radiused section.

4. The connector of claim 3 wherein the radiused section is substantially at a point halfway between the first side and the second side.

5. The connector of claim 1 wherein the angle between the contact surfaces and the sides of the body is acute.

6. The connector of claim 1 wherein the contact surfaces include a particle formed thereon.

7. The connector of claim 6 wherein the particle is made from diamond.

8. The connector of claim 1 further comprising:

a lip integrally formed with each of the contact surfaces and each is formed at an angle with respect to the contact surface.

9. The connector of claim 1 further comprising:

third and fourth sides perpendicular to the first and second sides of the body wherein the first, second, third, and fourth sides define the body.

10. The connector of claim 1 wherein a contact surface is formed at an end of each of the contacts wherein the end is bent at an angle with respect to the sides of the body.

11. The connector of claim 1 wherein the body and the contacts in combination provide a working range of compression between 0.005 inches to 0.025 inches.

12. The connector of claim 9 further comprising:

grooves formed in the third and fourth sides of the body wherein the grooves extend through the body and provide for resiliency of the connector.

13. The connector of claim 1 wherein the elastomeric material is silicone.

* * * * *